US005542319A

United States Patent [19]

Wei

[11] Patent Number: 5,542,319

[45] Date of Patent: Aug. 6, 1996

[54] ADJUSTABLE RACHET-STYLE SELF-TIGHTENING WRENCH

[76] Inventor: Chen Wei, 74 Pipashan Zheng Jie, Chongquing City, Sichuan Province, China, 630013

[21] Appl. No.: 423,545

[22] Filed: Apr. 17, 1995

[30] Foreign Application Priority Data

Apr. 15, 1994 [CN] China ..... 94209322.4

[51] Int. Cl.[6] ..... B25B 13/30

[52] U.S. Cl. ..... 81/105; 81/167

[58] Field of Search ..... 81/101, 105, 167

[56] References Cited

U.S. PATENT DOCUMENTS

| | | | |
|---|---|---|---|
| 669,483 | 3/1901 | Ingersoll | 81/105 |
| 2,629,280 | 2/1953 | Milligan | 81/105 |
| 3,015,246 | 1/1962 | Buyer | 81/167 |

*Primary Examiner*—James G. Smith
*Attorney, Agent, or Firm*—Margaret M. Dunbar

[57] ABSTRACT

The invention is an adjustable ratchet-style self-tightening wrench. The a wrench having a main body or handle, including a fixed jaw and a moveable jaw assembly which is pivotably attached to the main body. The handle has a first and a second end. The first end is for holding the wrench and applying force. The second end of the handle is shaped to form a fixed jaw having a substantially planar work surface. The handle also includes a recess near the fixed jaw end of the wrench with two leaf springs that are positioned to be biased against a pivot lug attached to the carriage block. The moveable jaw assembly includes a moveable jaw member, a traveler carriage block and a traveler carriage nut. The moveable jaw member has a traveler carriage segment at one end and a jaw working surface at it's other end. The moveable jaw assembly is pivotably attached to the main handle via a pivot lug that protrudes from the carriage block into the main handle recess. The pivot lug is held in place by the pivot pin at the center of the outsides of the handle recess. The carriage segment of the moveable jaw member includes threads to engage the traveler carriage block which is configured to function in the same manner as a conventional pipe wrench traveler carriage mechanism. The pivotal connection results in work pieces being held progressively tighter in the mouth of the wrench as stronger twisting forces are applied.

1 Claim, 2 Drawing Sheets

ADJUSTABLE RACHET-STYLE SELF-TIGHTENING WRENCH

TECHNICAL FIELD

The present invention relates to an adjustable ratchet-style self-tightening wrench.

Background Art

In the past, conventional adjustable wrenches did not continuously adjust the degree of tightness or "grip" which the wrench had on a work piece. Also, a conventional wrench can not adequately grip work pieces of different shapes. Additionally it can not grip and twist those work pieces when the work pieces are in the shapes of pipe, round, triangular and other irregular shapes.

Currently there is no known a self- adjusting gripping method which has been applied to a wrench to grab on to, and to twist the work pieces of different sizes and shapes, and without such a method, many various tools have to be utilized for the various work pieces.

Disclosure of the Invention

It is an object of the invention to provide a ratchet-style, self-tightening wrench to grip and to twist or apply force to work pieces of a variety of sizes and shapes. Another object of the instant invention is to provide a method for using the wrench of the present invention for applying a force to the work pieces of different sizes and shapes. A further object of the present invention is to provide a means for transmitting a twisting force to grip, hold and twist the work pieces of different sizes and shapes in such a manner that the stronger the twisting force applied, the tighter the work pieces in different sizes and shapes are gripped.

The above and other objects are accomplished by providing a wrench having a ratchet-style, self-tightening mechanism for gripping in a self-tightening fashion and twisting the work pieces of different sizes and shapes. The ratchet-style, self-tightening mechanism of the wrench allows the wrench to grip the work pieces in a manner such that that the stronger the twisting force that is applied, the tighter the work pieces are gripped. The wrench additionally has means for adjusting its jaw opening so that the ratchet-style self-tightening mechanism works all the way down to the smallest distance before the 2 jaws touch; so as to suit any smaller work pieces in a variety of different shapes. The method of applying the ratchet-style, self-tightening wrench to the work pieces comprises the steps of fitting the work pieces in the wrench of the present invention, and applying twisting force which is transmitted to the work pieces, these steps can be repeated any number of times, allowing the wrench to work in a ratchet-style fashion. The result of this invention is that the stronger the twisting force that is applied, the tighter the work pieces of different sizes and shapes are gripped.

According to the present invention, these and other objects are achieved by a wrench having a main body or handle, including a fixed jaw and a moveable jaw assembly which is pivotably attached to the main body. The handle has a first and a second end. The first end is for holding the wrench and applying force to enable the wrench to grip and twist work pieces. The second end of the handle is shaped to form a fixed jaw having a substantially planar work surface with small grooves or teeth in the work surface to improve the grip of the wrench. The handle also includes a recess near the fixed jaw end of the wrench. Within the recess there are two leaf springs that are positioned to be biased against the upper and lower surfaces of a pivot lug attached to the carriage block.

The moveable jaw assembly includes a moveable jaw member, a traveler carriage block and a traveler carriage nut. The moveable jaw member has a traveler carriage segment at one end and a jaw working surface at it's other end. The moveable jaw assembly is pivotably attached to the main handle via a pivot lug that protrudes from the carriage block into the recess in the main handle. The pivot lug is held in place by the pivot pin at the center part of the outsides of the handle recess.

The carriage segment of the moveable jaw member includes threads to engage the traveler carriage block which includes the traveler carriage block. This traveler carriage mechanism is configured to function in the same manner as a conventional pipe wrench traveler carriage mechanism.

The pivotal connection between the fixed jaw portion of the handle and the moveable jaw assembly results in keeping the work surfaces of the fixed jaw and moveable jaw substantially planar to each other. Additionally, the pivotal connection results in the work pieces being held progressively tighter in the mouth of the wrench as stronger twisting forces are applied.

Additional objects, advantages and novel features of the invention will be set forth in part in the description that follows, and in part will become apparent to those skilled in the art upon examination of the following or may be learned by practice of the invention. The objects and advantages of the invention may be realized and attained by means tithe instrumentalities and combinations particularly pointed out in the appended claims.

DETAILED DESCRIPTION OF THE PREFERRED EMBODIMENT

Figure 1:
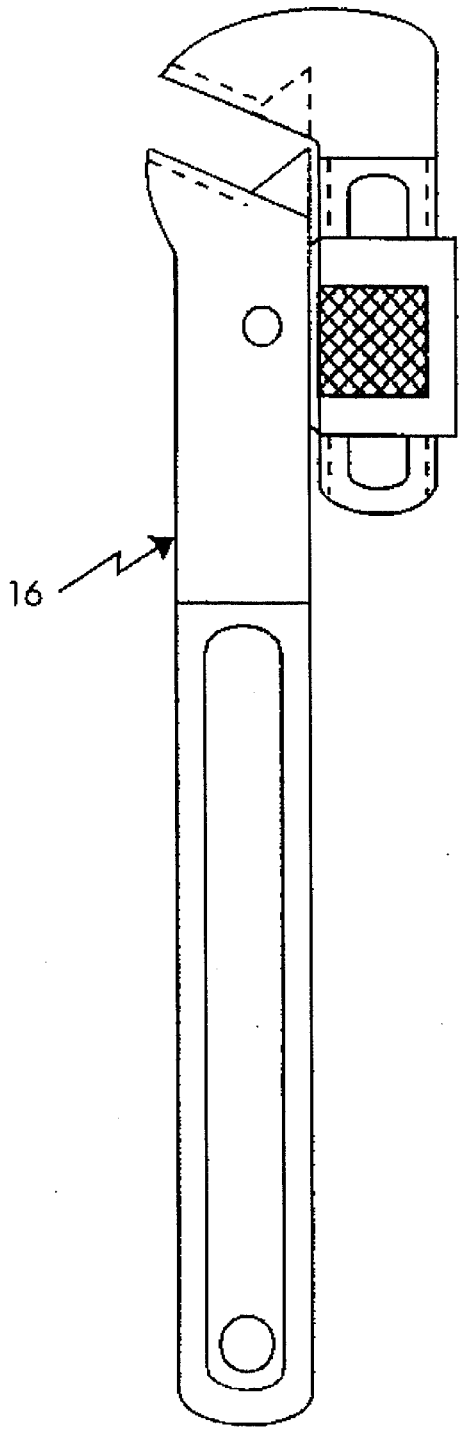
FIG. 1 is isometric view of the ratchet-style, self-tightening wrench.

A ratchet-style, self-tightening wrench is shown in the accompanying drawings and generally indicated at 16.

Referring now to FIGS. 1–4, wrench 16 has a main body or handle 1 including a fixed jaw 3. Pivotably attached to handle 1 is a moveable jaw assembly which includes moveable jaw member 9, having a traveler carriage 2 at one end and a jaw working surface 13 at it's other end, traveler carriage block 11 and a carriage traveler nut 10. The moveable jaw assembly is pivotably attached via a pivot pin and recess arrangement which will be explained later.

Handle 1 has a first end and a second end. The first end is for holding the wrench and applying force to enable wrench 16 to grip and twist work pieces. The second end of handle 1 is shaped to form fixed jaw 3. Handle 1 also includes a recess 5 positioned near the second end of handle 1. Fixed jaw 3 includes a substantially planar work surface 17 with small grooves or teeth 15 to improve the grip of fixed jaw surface 17 to work pieces, when using wrench 16. Handle 1 also includes pivot pin 7 which is located through the center of recess 5 and holds the moveable jaw assembly by pivotably attaching traveler carriage block 11 relative to fixed jaw surface 17. Jaw surface 17 includes a triangular shaped work piece stop 4 located on top of surface 17 at the edge of surface 17 that is closest to moveable jaw member 9. Work piece stop 4 provides a means for maintaining the work pieces between fixed jaw surface 17 and moveable jaw surface 13. Teeth 15 on jaw surfaces 17 and 13 facilitate gripping work pieces of various sizes and shapes.

Moveable jaw member 9 has a traveler carriage segment, here simply traveler carriage 2 located at one of it's ends which includes threads 12 sized to threadedly engage the threads of traveler nut 10. Additionally, moveable jaw member 9 includes a work surface 13 which opposes the fixed jaw work surface 17. Work surface 13 further has teeth 15, similar to those found on fixed jaw surface 17. Moveable jaw 9 has a recess extending into work surface 13 sized and shaped to receive work piece stop 4 when fixed jaw surface 17 and moveable jaw surface 13 are brought together.

The traveler-carriage mechanism, which includes traveler carriage 2, traveler nut 10 and carriage block 11, is configured to functions in the same manner as a conventional pipe wrench traveler carriage mechanism. Because this portion of the mechanism is conventional and well known it will not be explained in any greater detail.

Figure 2:
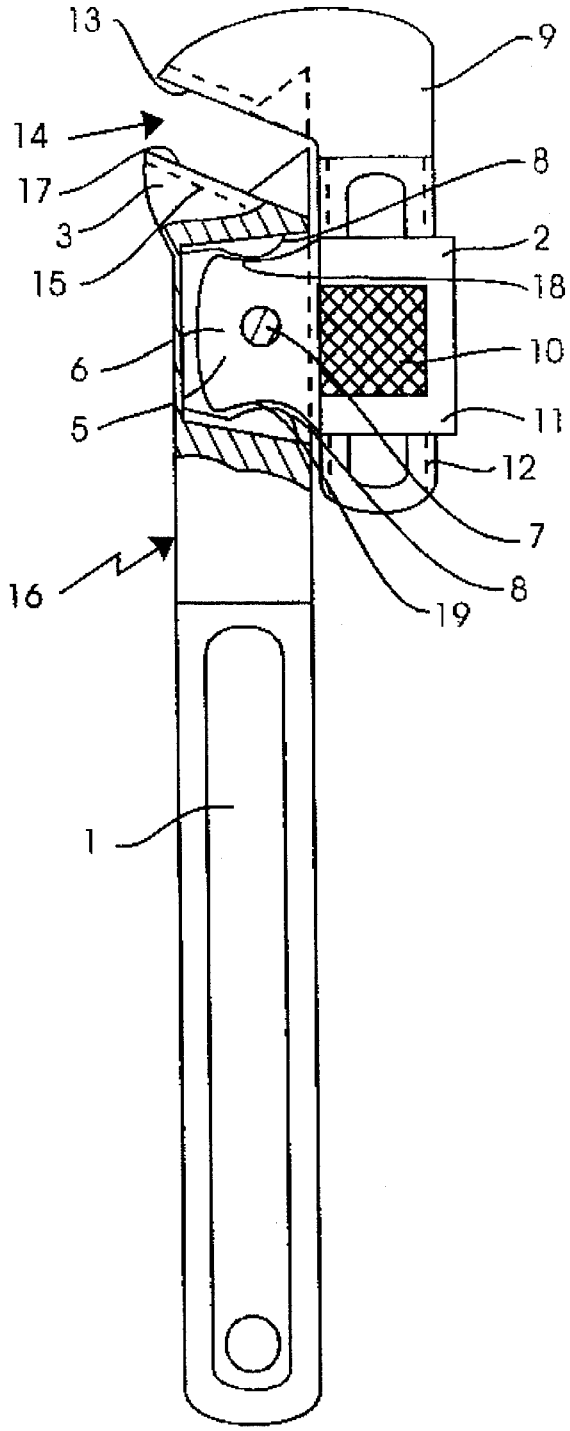
FIG. 2 is a cross section of the wrench in FIG. 1.

Referring to FIG. 2, carriage block 11 has a pivot lug 6 protruding into recess 5. Pivot lug 6 includes a rounded outside edge having upper and lower concave surfaces 18 and 19. Pivot lug 6 is connected by pivot pin 7 at the center part of the outsides of recess 5. Within recess 5 there are two leaf springs 8 biased against the upper and lower concave surfaces 18 and 19. This configuration results in carriage 2 being in a tensioned state and radially centered about pivot pin 7, keeping traveler carriage 2 in a balanced position where the working surfaces 13 and 17 are substantially parallel with each other.

Figure 3:
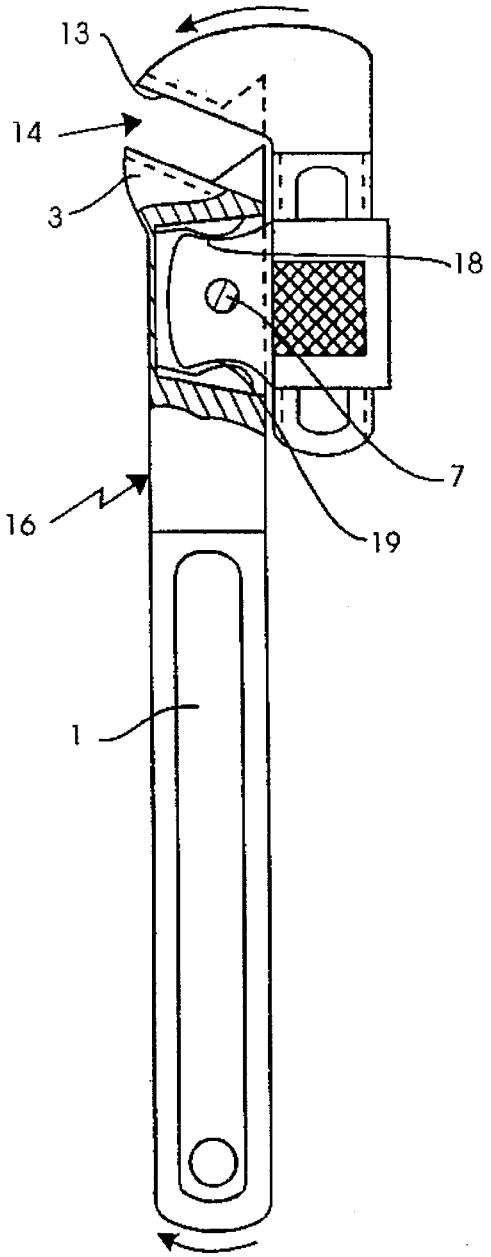
FIG. 3 is a cross section of the wrench in FIG. 2 illustrating how the wrench tightens about the work piece when twisting force is transmitted to the work piece, not shown.

The pivotal connection between fixed jaw surface 17 and moveable jaw surface 13 of mouth 14 provides two forces acting in different directions, as shown in FIG. 3. The force of fixed jaw surface 17 acts in a clockwise direction as a clockwise twisting force is applied to handle 1, while the applied force of moveable jaw surface 13 acts counter clockwise through pin 7 due to the same turning force, resulting in the jaw members tightening about the work piece. The result of this mechanism is that the work pieces are held progressively tighter in mouth 14 as stronger clockwise twisting are applied to handle 1.

Figure 4:
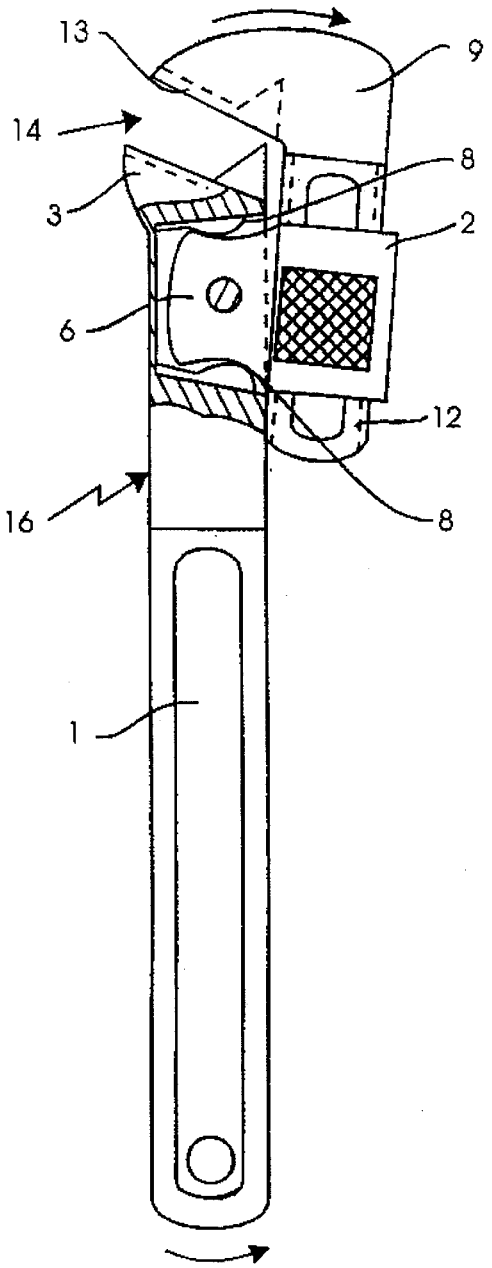
FIG. 4 is a cross section similar to FIG. 2 illustrating how when the applied force is released, the wrench loosens and allows the user to rotate the wrench in the opposite direction from that of the applied force, thereby facilitating a continuous or repetitive racheting motion.

In response to a counter-clockwise twisting force applied to handle body 1, the moveable jaw assembly pivots about pivot pin 7 to open the mouth 14, as shown in FIG. 4 sufficient to cross over work piece and allow wrench 16 to return into its original position, as shown in FIG. 3, ready for the next application of twisting force.

In use, mouth opening 14 of wrench 16 is adjusted just large enough to fit around the chosen work piece by turning traveler nut 10 to move moveable jaw 9. For a desired clockwise rotation of the work piece, wrench 16 is placed on the work piece from above the work piece with handle 1 being located to the right of the work piece. For a desired counter-clockwise rotation of the work piece, wrench 16 is placed on the work piece from above the work piece with handle 1 being located to the left of the work piece. If it is necessary to address the work piece from below the work piece, then the positions of handle 1 are reversed. In any case, traveler nut 10 is then adjusted to close mouth 14 about the work piece with traveler carriage block 11 positioned in it's balanced or neutral state. The twisting force is then applied to the work piece which causes mouth 14 to close tighter around the work piece during application of the force. Once the twisting force is released and an opposing force is applied, mouth 14 will open allowing wrench 16 to slide over the work piece and return to it's original position.

What is claimed is:

1. An adjustable ratchet-style self-tightening wrench which comprises:

a) a handle having a first end and a second end and a recess located near the second end of the handle, the second end of the handle including a jaw portion having a working surface;

b) a traveler carriage block having an adjusting nut therein for receiving a traveler carriage, the carriage block further having a pivot lug extending therefrom and including upper and lower concave surfaces, the pivot lug being sized and shaped to fit in the handle recess;

c) a moveable jaw member with a first end and a second end, having a working surface at one end of the jaw member and a traveler carriage segment at the other end of the jaw member, the traveler carriage segment including threads being in threaded engagement with the traveler carriage block nut;

d) a pivot pin pivotably attaching the pivot lug within the handle recess; and e) a pair of leaf springs being located within the handle recess between the handle and the concave surfaces of the pivot lug, the springs being configured to bias the pivot lug in a neutral position centered between it's range of pivotal movement.

* * * * *